United States Patent [19]

Parker

[11] 4,081,948

[45] Apr. 4, 1978

[54] MANUFACTURE OF BULKED YARN

[75] Inventor: Walter Parker, Congleton, England

[73] Assignee: Ernest Scragg & Sons Limited, Macclesfield, England

[21] Appl. No.: 766,071

[22] Filed: Feb. 7, 1977

[30] Foreign Application Priority Data

Feb. 17, 1976 United Kingdom ..... 6068/76

[51] Int. Cl.[2] ..... D02G 1/02

[52] U.S. Cl. ..... 57/34 HS; 57/157 S; 57/157 TS

[58] Field of Search ..... 57/34 R, 34 HS, 36, 57/51, 157 S, 157 TS, 157 R

[56] References Cited

U.S. PATENT DOCUMENTS

| | | | |
|---|---|---|---|
| 3,729,916 | 5/1973 | Lusk et al. | 57/34 HS |
| 3,733,801 | 5/1973 | Jones | 57/34 HS X |
| 3,793,817 | 2/1974 | Beringer et al. | 57/34 HS |
| 3,796,036 | 3/1974 | Parker | 57/34 HS X |
| 3,797,775 | 3/1974 | White | 57/34 HS X |
| 3,840,630 | 10/1974 | Yamada et al. | 57/157 TS X |
| 3,939,637 | 2/1976 | Franz et al. | 57/157 TS X |

*Primary Examiner*—Donald Watkins
*Attorney, Agent, or Firm*—Michael J. Striker

[57] ABSTRACT

Textile filaments are melt-spun, formed into a yarn, heated, cooled and false twisted while being simultaneously drawn, the upstream propagation of twist from the false twist device being arrested at the entry to the heater and the draw point of the yarn being stabilized on the heater. The twist arresting and draw point stabilizing means may be an abutment or pin with some filaments passing on each side, a radially pinned rotor, nip rolls or two parallel plates between which single filaments, but not twisted yarn, may pass. The false twist crimped yarn may be heat relaxed before wind up.

15 Claims, 5 Drawing Figures

10
11
12
13
14
15
16
17
18
19
20
21
22
23
24
25

MANUFACTURE OF BULKED YARN

The present invention relates to a process and apparatus for the manufacture of bulked yarns which comprises melt spinning, drawing and bulking the yarn by false-twist crimping, all in a continuous process which has become known in the art as an integrated spin-draw-texturing process.

It has previously been proposed to draw newly spun yarn in a separate step preceding a texturing step (sequential draw-texturing), for example as described in UK specifications Nos. 1,330,847 and 1,409,631, and it has also been proposed to carry out the drawing and texturing in a single combined step (simultaneous draw-texturing), for example as described in UK specification No. 1,174,867 Example 4.

The present invention provides a process and apparatus in which a bundle of parallel filaments forming a yarn, after leaving the spinneret of an extruder, is textured by being passed over a crimping heater and then traverses a cooling zone preceding a false twist device from which twist is propogated upstream and is set into the twisted yarn on the crimping heater, the yarn being drawn simultaneously with the texturising step and the bundle of parallel filaments being subjected to the action of a twist arresting device which is located in the region of the yarn entry end of the crimping heater and operates to stabilise the draw point of the yarn on the crimping heater.

The twist arresting device may comprise an abutment member, on each of the opposite sides of which pass some but not all of the filaments of the bundle which form a yarn, for example, half the filaments of the bundle pass on respective sides of the abutment member which may be in the form of a pin or plate member.

The abutment member may be located a short distance in advance of the yarn entry end of the crimping heater, or it may be located on the heater a short distance from the entry end, or preferably it may be located substantially at the entry end as by mounting a plate member on the heater casing at the yarn entry end of the heater.

Alternatively the twist arresting device may comprise a rotor having peripheral radial pins which define a circumferential zig-zag path around the rotor, nip rolls, or two parallel plates having a gap therebetween substantially equal to the diameter of a single filament and thereby insufficient to allow the twist to travel back between the plates to the upstream side thereof.

The invention will now be further described with reference to the accompanying drawings, in which.

Figures 1, 2, 3, 4, 5:
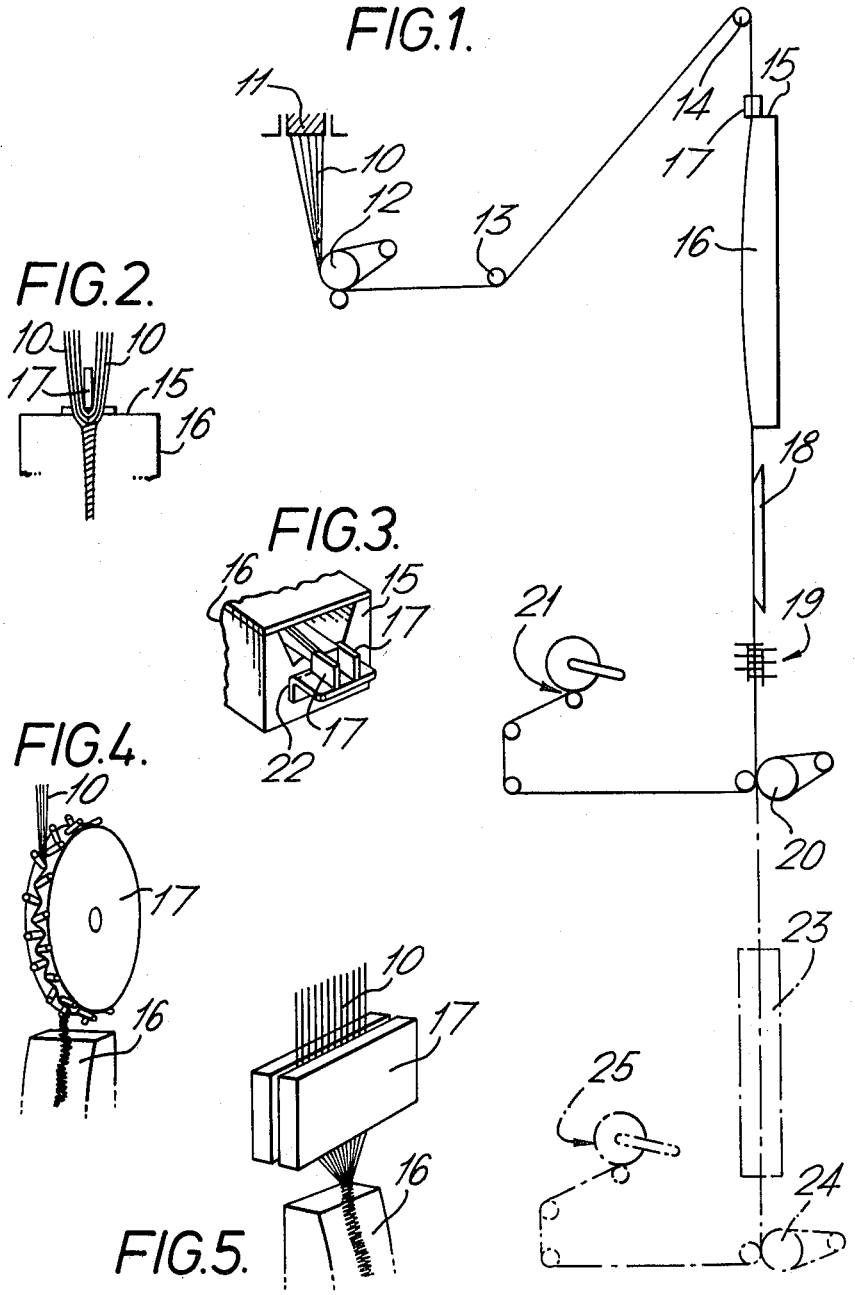
FIG. 1 is a diagram depicting in side elevation a single threadline of a multiple-threadline machine for the manufacture of bulked yarn.
FIG. 2 is an enlarged detail of FIG. 1, showing one type of twist stopping device.
FIG. 3 is a fragmentary perspective view of the yarn entry end of a heater, showing the twist stopping device of FIG. 2.
FIG. 4 shows one alternative type of twist stopping device.
FIG. 5 shows a second alternative type of twist stopping device.

Referring to FIG. 1., a bundle of parallel filaments 10, emerging from the spinneret 11 of an extruder, form a yarn which passes through an infeed roller assembly 12 of conventional form, and then travels via appropriately located guides 13 and 14 to the yarn entry end 15 of a crimping heater 16. At the entry end is located a twist stopping device 17, which also operates to stabilise the draw point of the yarn on the crimping heater 16, over which the filaments then pass followed by a cooling zone which may be ambient air or which may include a cooling and stabilising yarn contact plate 18, a false twist device 19, a conventional delivery roller assembly 20 and finally a package windup system 21.

Preferably the false twist device comprises overlapping sets of friction discs on three parallel shafts, with the yarn running in a zig-zag spiralling path over the disc rims, such a false twist device being disclosed in our British patent specifications Nos. 1,419,085; 1,419,086 and 1,419,087.

The delivery roller assembly is driven faster than the infeed roller assembly 12, the speed difference being that required to draw the yarn at the required draw ratio, the drawing being effected simultaneously with false twist crimping since twist propogated upstream of the false twist device 19 is set by the crimping heater 16 and at the same time the twisted yarn is drawn on the crimping heater 16.

The twist stopping device 17 as shown in FIG. 1 may comprise a pair of nip rolls between which the filaments pass.

As illustrated in FIG. 2, the twist stopping device 17 comprises a plate member past which twist cannot pass in the upstream direction, substantially half of the filaments 10 of the bundle passing on each side of the plate member.

An abutment plate member 17, or a pin operating in the same way, could alternatively be spaced slightly before the yarn entry end of the crimping heater or even on the heater spaced slightly downstream of its yarn entry end. It is also envisaged that other forms of twist arresting devices could be used, such as those shown in FIGS. 4 and 5 which are respectively a rotor with peripheral radial pins defining a zig-zag yarn path about the rotor, and a pair of parallel plates having a gap therebetween substantially equal to the diameter of a single filament and thereby insufficient to allow the twist to travel back between the plates to the upstream side thereof.

However, a twist stopping device 17 such as the plate member of FIG. 2 is preferred, since the twist cannot possibly slip past it, and in FIG. 3 is depicted the entry end 15 of a wellknown form of twin-track contact heater 16 for a pair of yarns, at the entry end of which two twist stopping devices 17 in the form of abutment plate members are shown mounted on a common bracket 22 secured to the end face of the heater casing.

FIG. 1 further includes, in chain-dot lines, an alternative arrangement in which crimped yarn from delivery roller assembly 20 does not go direct to windup system 21, but runs with overfeed through a secondary heater 23, for crimp modification and stretch reduction, before passing from an output roller assembly 24 to a windup system 25.

What we claim is:

1. A process for the manufacture of bulked multi-filament yarns comprising the steps of melt-spinning a plurality of filaments, combining the filaments to form a yarn, texturising the yarn by passing it through a heating zone and a cooling zone and then false twisting the yarn so that the twist is propagated upstream and is set in said heating zone, arresting the upstream propagation of twist of a point located substantially at the entry to said heating zone, drawing the yarn simultaneously with said texturizing step and stabilising the draw point of the yarn in said heating zone.

2. A process according to claim 1 further comprising the step of winding the textured yarn, in the form of a package.

3. A process according to claim 1 further comprising the steps of overfeeding the textured yarn through a second heating zone and then winding it up in the form of a package.

4. Apparatus for the manufacture of bulked multi-filament yarns comprising means for melt-spinning a plurality of filaments, means for combining the filaments to form a yarn, means for texturising said yarn comprising heating means, cooling means and a false twist device, means for arresting the propagation of twist upstream from said false twist device at a point location substantially at the entry end of said heating means, means for drawing the yarn simultaneously with it being textured, and means for stabilising the draw point of the yarn on said heating means.

5. Apparatus according to claim 4 wherein said twist arresting means also acts as said means for stabilising the draw point of the yarn on said heating means.

6. Apparatus according to claim 5 wherein said twist arresting means comprises an abutment member on either side of which substantially half of said filaments are caused to pass.

7. Apparatus according to claim 5 wherein said twist arresting means comprises a rotor having peripheral radial pins which define a circumferential zig-zag path for the yarn around said rotor.

8. Apparatus according to claim 5 wherein said twist arresting means comprises a pair of nip rolls between which said filaments are caused to pass.

9. Apparatus according to claim 5 wherein said twist arresting means comprises a pair of parallel plates having a gap therebetween substantially equal to the diameter of a single filament and insufficient to allow passage of the twisted multi-filament yarn.

10. Apparatus according to claim 5 wherein said heating means comprises a heated plate in contact with which said yarn is caused to travel.

11. Apparatus according to claim 10 wherein said cooling means comprises a cooled plate in contact with which said yarn is caused to travel.

12. Apparatus according to claim 5 wherein said false twist device comprises overlapping sets of friction discs on three parallel rotating shafts, said discs having rims and defining a zig-zag spiral path for the yarn travelling over said rims.

13. Apparatus according to claim 5 wherein said drawing means comprises a pair of feed rolls which are located upstream of said heating means and a pair of draw rolls which are driven in rotation at a peripheral speed greater than the peripheral speed of said feed rolls and which are located downstream of said false twist device.

14. Apparatus according to claim 5 further comprising means for winding up the textured and drawn yarn in the form of a package.

15. Apparatus according to claim 14 further comprising a second heating means located between said drawing means and said package winding means.

* * * * *